United States Patent [19]

Ibrahim

[11] 4,361,012

[45] Nov. 30, 1982

[54] ENERGY EFFICIENT REFRIGERATED MERCHANDISER DISPLAY CASE

[75] Inventor: Fayez F. Ibrahim, Niles, Mich.

[73] Assignee: Tyler Refrigeration Corporation, Niles, Mich.

[21] Appl. No.: 184,033

[22] Filed: Sep. 4, 1980

Related U.S. Application Data

[63] Continuation-in-part of Ser. No. 145,712, May 1, 1980, Pat. No. 4,325,227, which is a continuation-in-part of Ser. No. 141,359, Apr. 18, 1980, and Ser. No. 141,360, Apr. 18, 1980, which is a continuation-in-part of Ser. No. 101,069, Dec. 7, 1979, Pat. No. 4,265,090, which is a continuation-in-part of Ser. No. 58,916, Jul. 19, 1979, Pat. No. 4,242,882, which is a continuation-in-part of Ser. No. 25,473, Mar. 30, 1979, Pat. No. 4,245,482.

[51] Int. Cl.[3] ..... F25D 21/12; A47F 3/04

[52] U.S. Cl. ..... 62/82; 62/255; 62/256; 62/282

[58] Field of Search ..... 62/255, 256, 282, 82

[56] References Cited

U.S. PATENT DOCUMENTS

| | | | |
|---|---|---|---|
| 2,960,844 | 11/1960 | Quick | 62/256 X |
| 3,365,908 | 1/1968 | MacMaster | 62/256 |
| 3,392,544 | 7/1968 | Perez | 62/256 |
| 3,850,003 | 11/1974 | Beckwith et al. | 62/256 X |
| 3,937,033 | 2/1976 | Beckwith et al. | 62/256 |
| 4,072,488 | 2/1978 | Johnston | 62/282 |

*Primary Examiner*—Lloyd L. King

*Attorney, Agent, or Firm*—LeBlanc, Nolan, Shur & Nies

[57] ABSTRACT

An energy efficient refrigerated display cabinet having glass barrier doors and one or more guard air bands to protect the primary refrigerated air band. A single guard air band is circulated about the primary refrigerated air band in order to protect the same from contact with the inner walls of the cabinet or the ambient air upon opening of the barrier doors. The cabinet can be provided with an air defrost system in which ambient air is taken in through ports in the cabinet which are selectively closed by gates or through a gap between the barrier doors and the associated access opening. An ambient air band can also be provided for circulation across the outer surface of the barrier doors in order to slightly raise the heat transfer into the glass panes in order to aid reduction of moisture condensate formation on the glass panes.

36 Claims, 9 Drawing Figures

ENERGY EFFICIENT REFRIGERATED MERCHANDISER DISPLAY CASE

RELATED APPLICATIONS

The present application is a continuation-in-part of application Ser. No. 145,712 filed May 1, 1980, now U.S. Pat. No. 4,325,227, which is a continuation-in-part of application Ser. No. 141,359 and of application Ser. No. 141,360, both filed Apr. 18, 1980, which are continuations-in-part of application Ser. No. 101,069 filed Dec. 7, 1979, now U.S. Pat. No. 4,265,090, which is a continuation-in-part of application Ser. No. 58,916, filed July 19, 1979, now U.S. Pat. No. 4,242,882, which is a continuation-in-part of application Ser. No. 25,473, filed Mar. 30, 1979, now U.S. Pat. No. 4,245,482.

BACKGROUND OF THE INVENTION

The present invention relates to a "reach-in" merchandiser type of refrigerated display case or cabinet used primarily in retail food and supermarket outlets. The term "refrigerated", in accordance with the present invention is intended to incorporate those cases maintained at a temperature at or in excess of 32° F., such as display case utilized for display of milk and fresh foods, and those cases maintained below 32° F., such as frozen food cases. In addition, references are made herein to the use of transparent doors, since those are the types of doors most frequently utilized in such retail outlets. Other types of doors could also be employed within the scope of the present invention.

An increasing market demand made by managers of retail food outlets is to reduce the energy consumption of refrigerated display cabinets in order to reduce operating costs wherever possible. Various approaches have been used to conserve the energy required to operate these display cases. When the display case is operated as an open-front or an open-top cabinet to permit freer customer access to the stored products, the primary refrigerated air band circulated within the cabinet is often protected by one or more outer air bands such as disclosed in U.S. Pat. No. 4,144,720 issued to Subera et al which is assigned to the same assignee as the present application. In the Subera patent, an open-front refrigerated display case having primary and secondary air conduits is disclosed. An additional ambient air curtain is provided so that the refrigerated air band is protected by two outer air bands flowing in the same direction across the open access area of the case. Another approach to conserve operating energy has been to install barrier doors in order to limit the contact of ambient air with the refrigerated air band to those time periods during which customers or employees hold open the barrier doors. This type of refrigerated display cabinet is shown in U.S. Pat. No. 4,072,488 to Johnston and in the above referred to copending applications of the inventor hereof.

It has not been deemed necessary to protect the refrigerated air band by the provision of additional outer air bands to reduce operating energy and to limit exposure to ambient air during those time periods when the barrier door is opened. Consequently, the prior art refrigerated display cabinet having barrier doors have been constructed for single air band operation, whereas the open-front and open-top refrigerated cases have been constructed with multiple bands in order to protect the refrigerated air band from contact with ambient air.

This invention is based on recognition that a more energy efficient refrigerated display case can be constructed by utilizing both a barrier door and multiple air bands to reduce inward heat transfer from the warmer ambient air. If these divergent solutions to the problems of energy conservation are utilized in a unique manner, operating costs can be lowered due to the energy saved.

In the operation of all types of refrigerated display cabinets, it is desirable to include a system for automatically defrosting the refrigeration coils. The defrost cycle can be actuated either at set periodic time intervals or when the frost buildup within the system has reached a certain predetermined level. Such systems are typically thermostatically controlled so as to switch from a refrigeration cycle to a defrost cycle of operation. In this manner of operation it is possible to avoid any significant frost buildup within the display cabinet such that inoperability and spoilage of food products would occur.

There have been three different approaches for defrosting refrigerated display cabinets in the art. These are, utilizing electric resistance heaters; passing a compressed refrigerant gas having a high specific heat through the refrigeration coils; and, circulating ambient air through an air conduit in which the refrigeration coils are positioned. Due to the increased cost of energy, efforts have been made to place more emphasis on the utilization of ambient air defrost system as an alternative to the electrical resistance heaters or compressed refrigerant gas defrost systems.

The present invention based on using both a barrier door and multiple air bands in a refrigerated display cabinet is usable with each of these three different defrosting approaches. In particular, the energy conserving refrigerated display case of the present invention provides for a defrost cycle in which ambient air is circulated through an air conduit in which the refrigeration coils are positioned in order to achieve lower operating costs. One energy efficient way to defrost the coils with ambient air is to connect the air conduit with ambient air ports covered by openable gates which permit the through-flow of air when in an open position. Another energy efficient way to defrost is to create a gap between the barrier door and its associated access opening and to use this as a port in order to provide for through-flow of ambient air in order to defrost the refrigeration coils.

In refrigerated cabinets having single refrigerated air bands protected by glass barrier doors, the refrigerated air band may have a temperature as low as about −25° F. and a humidity ratio of 0.0002 lbs water/lb. dry air. Upon opening the barrier door to gain access to the displayed products, this air band comes in contact with ambient air which can have a temperature as high as about 75° F. and a 55% relative humidity which involves a humidity ratio of 0.01 lbs. water/lb. dry air. The temperature difference upon opening the barrier door is then about 100° F. and the humidity ratio difference is approximately 0.0098 lb. water/lb. dry air. This type of contact can result in considerable heat transfer to the refrigerated air band both in the form of heat exchange between the moving air band and the stationary ambient air and by means of mass transfer of moisture which increases the refrigeration energy required for operation of the display cabinet since that moisture must be condensed in the form of frost or ice. The heat of condensation for that moisture must be extracted by the refrigeration apparatus. This type of heat transfer can raise the refrigeration load in a cabinet even above that required by multi-air band open-front cases having no barrier doors. To solve this problem, one or more outer air bands can be provided to protect the primary refrigerated air band against direct contact with ambient air during those times when the merchandiser doors are opened. Also the circulation of the outer air band or bands reduces heat transfer from outside of the cabinet because this secondary air band will have a temperature approximately 10° F. to 15° F. higher than that of the primary air band and hence the outer surfaces of the cabinet will also be at higher temperatures than when only a primary air band is used.

The problem of protecting refrigerated air bands against contact with the ambient air has been solved in other ways using curtains which do not permit for the low energy air defrost systems or do not permit customer entry. Beckwith et al, U.S. Pat. No. 3,403,525 discloses a night curtain which is to be placed over the normally open access area of a refrigerated case in order to reduce energy consumption during the "nonsales" hours, but with this arrangement no air defrost or customer entry is possible. Vogel, U.S. Pat. No. 4,117,698 discloses a retractable night curtain for use during closed store hours during which no provision is made for customer entry.

In designing refrigerated display cabinets to be defrosted by ambient air, a number of different systems have been employed. One type of system which employs ambient air during a defrost cycle is exemplified by U.S. Pat. Nos. 3,403,525; 3,850,003 and 3,937,033, all to Beckwith et al. These systems use fans separate and distinct from the main circulating fans to move ambient air across the refrigeration coils for defrosting. The additional fans are turned on only during the defrost cycle of operation for pulling ambient air from outside of the display cabinet directly into the air conduits located within the walls of the cabinet. A second type of system is illustrated in U.S. Pat. No. 3,082,612 to Beckwith, which system draws ambient air into the main circulation path through ports located in the lower front panel of the refrigerated display cabinet. Such ports are normally closed during the refrigeration cycle and opened during the defrost cycle. The Beckwith et al, 3,850,003 patent indicates that the concepts described in Patent Nos. 3,082,612 and 3,402,525 did not prove to be practical and hence were not commercially feasible.

Some of the above-noted patents directed to air defrost systems use reverse air flow, during the defrost cycle of operation. U.S. Pat. No. 4,026,121 to Aokage, et al, which illustrates an open-front display case, and U.S. Pat. No. 4,120,174 to Johnston, which illustrates an open-top display case, also disclose reverse ambient air flows for defrosting. In these, ambient air can easily be drawn through the access opening of the case or cabinet into the air conduit through the outlet opening of the air conduit and then expelled from the air conduit after the defrost operation through the unblocked access opening. Such an arrangment, however, can not be readily used in a refrigerated merchandiser display case having barrier doors, since the front opening in the cabinet is covered by the doors. Thus, in order to employ an ambient air defrost system, a different type of system had to be conceived.

In seeking to employ ambient air defrost techniques in cases having doors, systems have been developed for drawing air through a limited portion of the air conduit by opening flaps into the conduit. These flaps are arranged so as to straddle the evaporator coils of the refrigeration mechanism. Such systems are disclosed in U.S. Pat. No. 3,226,945 to Spencer and U.S. Pat. No. 4,072,488 to Johnston. The patent to Spencer illustrates a plurality of different embodiments of open-top refrigerated display cases, both of the single shelf and multi-shelf types, in which the air flow is always drawn over evaporator coils in a single direction under negative pressure. During the refrigeration cycle of operation, air after being refrigerated is circulated through the air conduit and into the display section of the case. Pat. No. 4,072,488 to Johnston discloses a glass door type merchandiser display cabinet in which air is circulated through the air conduit and through the evaporator coils arranged within the air conduit in such a direction that cold air enters the display space at the bottom of the cabinet and is then drawn up into the air inlet located near the top of the cabinet. For defrosting, top flaps are opened since this case is designed with coils at the top. This shows a somewhat complicated way to provide both glass doors and air defrost features according to the prior art. Such systems are relatively complex and can involve certain operational problems, particularly due to frost and dust accumulation. Where there are moving parts inside of the air conduit an accumulation of frost on such parts can cause them to stick and hence not function properly.

SUMMARY OF THE INVENTION

An improvement in refrigerated display cabinets is provided in which barrier doors and one or more guard air bands protect the primary refrigerated air band. Provision is also preferrably made for air defrost of the refrigeration means within the cabinet.

A single guard air band is circulated about the primary band in the refrigeraton cycle of operation. An ambient air band can be passed across the outer surface of the barrier door in order to warm the glass panes slightly so that condensate on the interior glass pane surfaces can be reduced. This ambient band also reduces the air convection contact between the secondary guard band and the ambient air which is not moving in the same direction when the door is opened. When two guard air bands are employed, the outermost of these which is directed across the outside surface of the barrier door and can run continuously or only during those time periods when the access door is opened in order to achieve low energy consumption operation of the cabinet.

Air defrost for the cabinet having a barrier door positioned across the access port is achieved by providing an air defrost means which selectively creates openings between gates and ambient air ports in the cabinet including a gap between the barrier door and the associated access opening in order to effect defrosting in a simple and low energy consumption manner.

It is therefore, an object of the present invention to provide a more energy efficient refrigeration display cabinet having both one or more barrier doors and one or more guard air bands.

Another object of the present invention is to provide an energy conserving refrigerated display cabinet of the above type with an air defrost means which selectively creates openings to permit ambient air through-flow including, if desired, a gap between a barrier door and the access opening covered by the door in order to provide for ambient air passage through the cabinet for defrosting purposes.

Specific preferred embodiments of the invention will be described below with reference to the appended drawing figures.

BRIEF DESCRIPTION OF THE DRAWINGS

FIG. 9 is a schematic view of the refrigerated display cabinet illustrated in FIG. 8 showing the ambient air gates in whereby through-flow of ambient air during a defrost cycle is provided for.

DESCRIPTION OF THE PREFERRED EMBODIMENT

Figure 1:
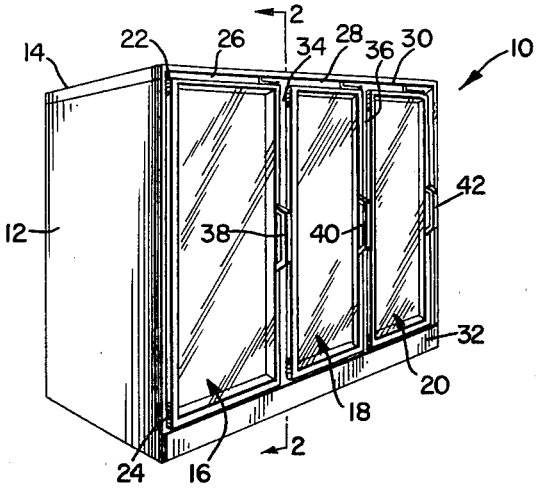
FIG. 1 is a perspective front view of the refrigerated display cabinet of the present invention.
Figure 2:
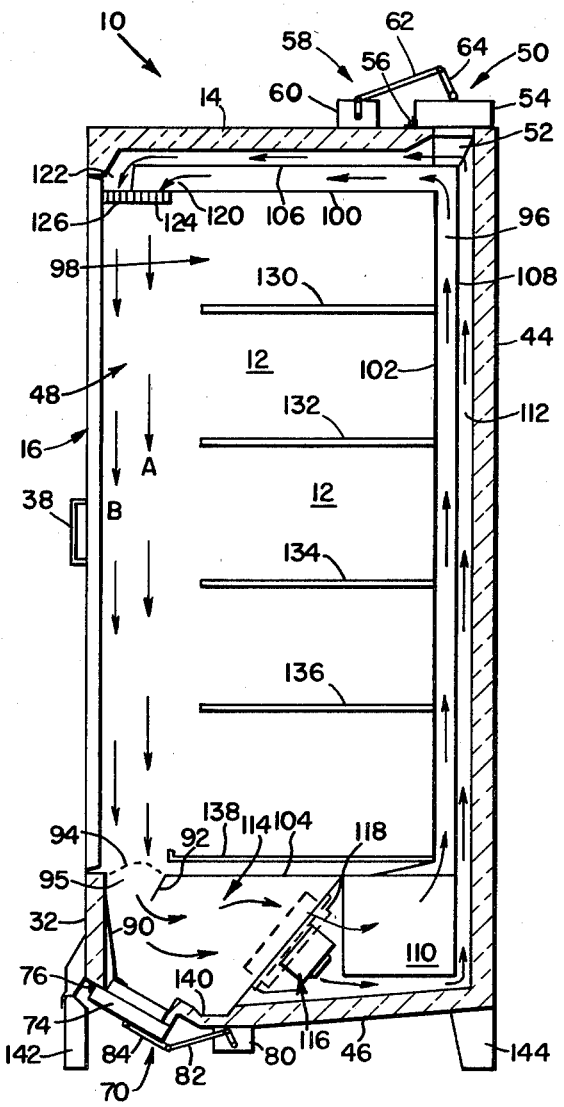
FIG. 2 is a side cross-sectional schematic view of the refrigerated display cabinet of FIG. 1 taken on line 2—2 having multiple-circulated air bands and a barrier door which is fitted with top and bottom ambient air ports.
Figure 3:
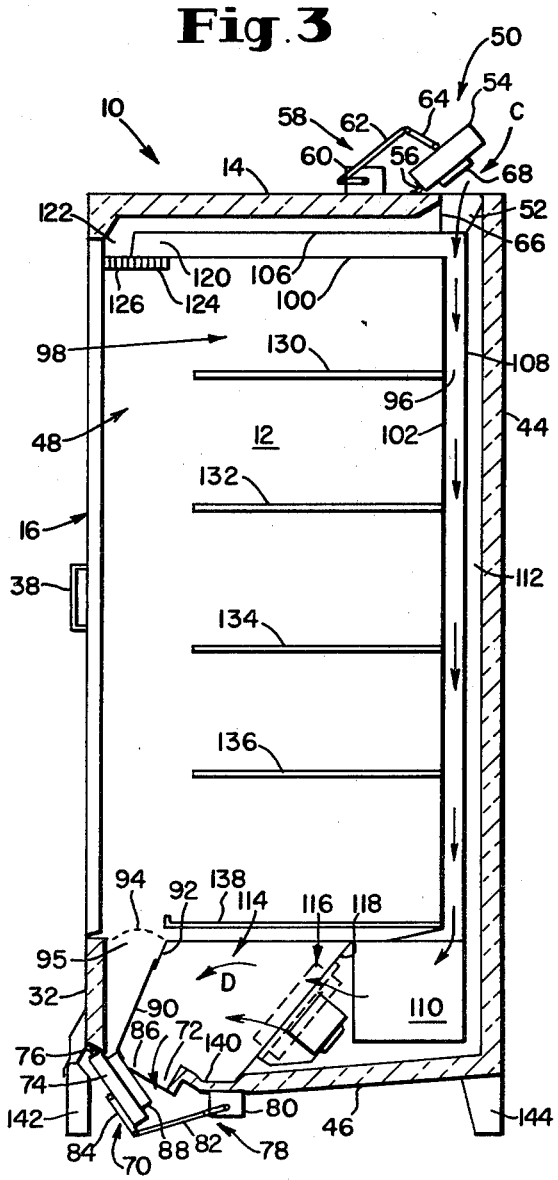
FIG. 3 is a schematic view of the refrigerated display cabinet illustrated in FIG. 2 showing the top and bottom ports opened for through-flow of ambient air.

Referring now to FIGS. 1–3, a refrigerated display cabinet 10 is shown with one end wall 12 and a top wall 14. A series of 3 glass paneled barrier doors 16, 18 and 20 are mounted for pivotally opening about hinges 22 and 24, which are provided in pairs for each of the doors. The barrier doors have door jambs 26, 28 and 30 at the top thereof which are integrally connected to top wall 14. The barrier doors 16, 18 and 20 are mounted in cabinet 10 above front wall 32 and door mullions 34 and 36 separate the middle door 18 from the two doors on either side. Conventional handles 38, 40 and 42 are provided to facilitate opening of the doors.

FIG. 2 shows rear wall 44 which is connected to top wall 14 along the back edge thereof. Bottom wall 46 is, in turn, connected to the lower edge of rear wall 44 and extends forward to connect with front wall 32 at the lower edge thereof. Glass paneled barrier door 16 is shown mounted in access opening 48 which is covered when door 16 is in closed position. A top gate 50 is positioned to cover port 52 at the juncture of top wall 14 and rear wall 44. Gate 50 can be in the form of a circular member (viewed in cross section in FIGS. 2 and 3) or an elongated rectangular member in which case several such gates are positioned across the length of the display cabinet as shown in FIG. 1. Gate 50 is constructed with a lid 54 which is connected to top wall 14 by hinge 56 and is operated by motor-linkage mechanism 58 which has an electric motor 60 connected by links 62 and 64 to the top surface of lid 54. When motor 60 is energized, link 62 is pulled downwardly toward the top surface of top panel 14 thus causing lid 54 to pivot about hinge 56. Lid 54 is thus drawn upwardly and away from port 52 which is constructed with a throat member 66. Lid 54 is constructed with a lower stopper portion 68 which interfits with the inner portion of throat member 66 in order to create an air-tight seal therebetween. If desired, various sealing rings and polymeric surfaces can be established between lid 54, stopper portion 68 and throat member 66.

A lower gate 70 is provided in bottom wall 46 and is of similar construction of gate 50 for selectively covering port 72. A lid 74 is pivotally mounted by hinge 76 and is operated by motor-linkage assembly 78 which consists of a bottom motor 80 and links 82 and 84, the latter of which is connected to the lower surface of lid 74. Port 72 is formed by a throat 86 which forms a air-tight seal with plug portion 88 of lid 74. An air deflector vane 90 is affixed to the top most portion of plug 88 for swinging against stop member 92 when gate 70 is moved to an open position as shown in FIG. 3. This opening movement diverts the flow of air away from air grille 94 located adjacent to front wall 32 near the bottom of door 16.

A first air conduit 96 is arranged about display space 98 and is formed by inner top wall 100 which is connected at its rear edge to rear inner wall 102 which extends downwardly and connects at its lower edge to bottom member 104. The outer surface of the first conduit 96 is formed by a top divider panel 106 which is in turn connected at its rear edge to divider panel 108 which extends downwardly to the lower edge of refrigerator coil box 110. A second air conduit 112 is formed between divider panels 106 and 108 and top wall 14 and rear wall 44, respectively. The two air conduits 96 and 112 have a common inlet chamber 114 located at the bottom of the cabinet adjacent to motor-driven fan assembly 116 which is mounted in bracket 118.

As shown in FIG. 2, motor-driven fan assembly 116 establishes the circulation of a primary air band A and a second air band B within the first air conduit 96 and the second air conduit 112, respectively. These two air bands flow in a counterclockwise direction downwardly across the inner surface of door 16 and then through air grille 94 and into inlet 95 and then the common conduit chamber 114 before passing through the refrigeration coils 110 and then upwardly in the rear portion of the conduits and across the top of the conduits and then out of outlet 120 in the first conduit and outlet 122 at the top of the second conduit. Downwardly directed louvers 124 and 126 are located in outlets 120 and 122, respectively. Some intermixing of the two air bands A and B occur as these air bands are circulated downwardly across the inner surface of door 16 and into the common chamber 114, but otherwise the two air bands are separated by divider panels 108 and 106 in the direction of the air band flow during the refrigeration cycle as shown in FIG. 2. A series of product shelves 130, 132, 134 and 136 are provided by attaching the same to rear inner wall 102. A bottom shelf 138 is also provided for product storage.

Since the secondary air band B does not pass through the refrigeration coil box 110 but rather is diverted thereunder in the lower horizontal portion of the second conduit 112, this band is maintained at approximately 10° F. to 15° F. higher in temperature than the primary air band A. When door 16 is opened for product entry or removal, it is the secondary band B which is contacted by the static ambient air and thus takes in heat by radiation, conduction and by mass transfer mechanisms. Ambient air moisture is also transferred to band B at the same time which then diffuses into the primary air band A when the two bands are in contact with one another adjacent to the inner surface of door 16 and in the lower common chamber 114. The provision of the secondary air band B within cabinet 10 allows the inner surfaces of barrier door 16, bottom wall 46, rear wall 44 and top wall 14 to be maintained at about 10° F. to 15° F. higher temperature than would occur if the refrigerated primary air band A were in direct contact with these surfaces. The higher temperatures at these inner surfaces then reduces the inflow of heat from the surrounding air according to the standard heat transfer equation which holds that the rate of heat transferred over a given contact area is directly proportional to the difference in temperature between the two transfer points, in this case the inner and outer surfaces of the outer walls of cabinet 10. It is of course desirable to construct cabinet 10 with outer wall materials having low coefficients of heat transfer.

Upon the sensing of a predetermined amount of frost and ice in refrigeration coil box 110 the air defrost control means associated with cabinet 10 causes the refrigerant flow to terminate in the coils within coil box 110 and for top gate 54 and bottom gate 74 to be opened by the motor-linkage assemblies 58 and 78, respectively. At the same time, motor-driven fan assembly 116 is reversed so that ambient air C is drawn in through top port 52 and downwardly in throat member 66 and caused to flow in a reverse direction downwardly in conduit 96 and through the coil box 110 in order to defrost the same. The defrost air D is then ejected from the bottom portion of cabinet 10 through port 72 and the flow of the defrost air is diverted from flowing in a reverse direction thru air grille 94 by deflector vane 90 which is integrally affixed to the top portion of lid 74. A drain channel 140 is formed in bottom wall 46 and this channel connects with bottom drains (not shown). Water from the melted ice and frost is carried off via channel 140 and its associated drains.

Cabinet 10 is provided with support legs 142 and 144. If desired, fluorescent lighting fixtures can be arranged at various internal positions such as the inner surfaces of door mullions 34 and 36 shown in FIG. 1.

Refrigerated cabinet 10 is more energy efficient than cabinets in the prior art due to the provision of the secondary air band B which limits heat transfer from the ambient air into the display space 98 during refrigeration cycles of operation. This secondary air band also establishes a guard air curtain which first contacts the static ambient air when barrier door 16 is opened thus protecting the primary refrigerated air band A from direct contact with the ambient air. Cabinet 10 is also operated with a single motor-driven fan assembly 116 which means that only single motors are necessary at given longitudinal positions and these are of course spaced across the length of cabinet 10 as shown in FIG. 1. Another feature is that air defrost is provided for via the ports 52 and 72 which are covered by gates 50 and 70 respectively. This type of defrosting requires much less energy than either electric resistant heaters or hot refrigerant gas lines which are sometimes provided within the refrigeration coil box 110 in the prior art. It is for these reasons that cabinet 10 is more energy efficient than the prior art. Gates 50 and 70 can also be opened by solenoids rather than the motor-linkage mechanisms 58 and 78.

Figure 4:
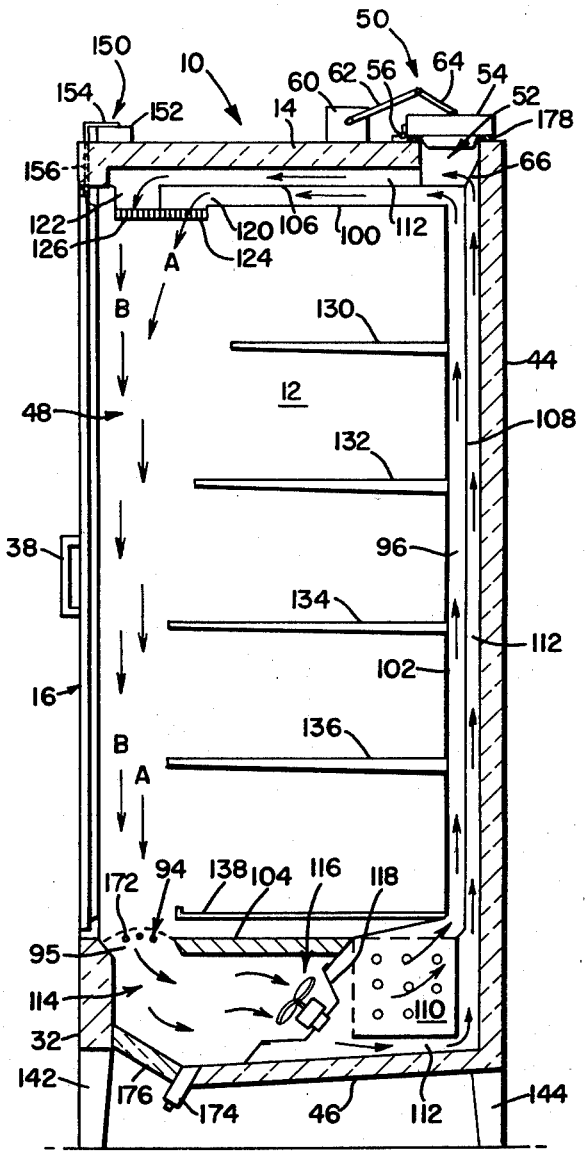
FIG. 4 is a side cross-sectional schematic view of another embodiment of the present invention wherein one of the ambient air ports is formed by the opening of the barrier door away from the access opening.
Figure 5:
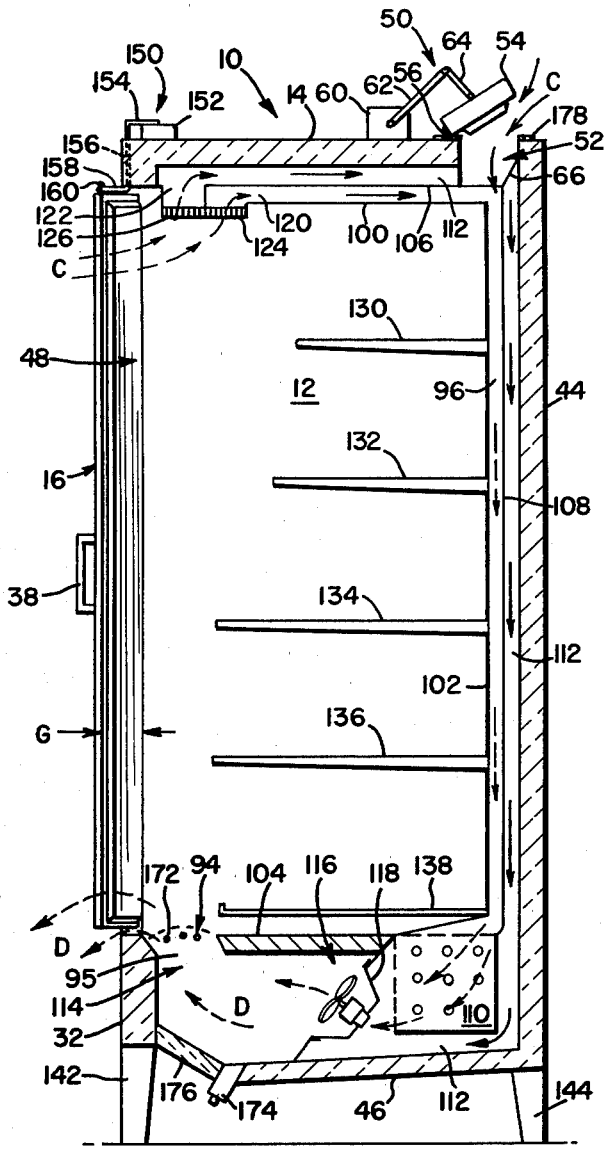
FIG. 5 is a schematic view of the refrigerated display cabinet illustrated in FIG. 4 showing the ambient ports opened for through-flow of air in a defrost cycle.
Figure 6:
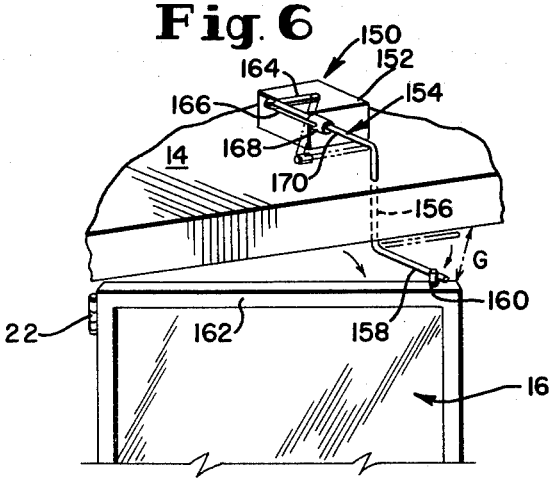
FIG. 6 is a perspective schematic view of a refrigerated display cabinet showing the door opening mechanism of the air defrost means.

FIGS. 4–7 show another embodiment of the present invention in which the refrigerated cabinet 10 is provided with a door opening mechanism 150 affixed to top wall 14. The door opening mechanism consists of a motor 152 and a linkage system 154 which operates a rotatable rod 156 supported in the front portion of top wall 14 which has an operator lever 158 affixed to the lower end thereof for acting against a stud 160 affixed to the top frame 162 of door 16. As best shown in FIG. 6, motor and gear mechanism 152 has a swing arm 164 attached to the output shaft thereof which is, in turn, attached to link member 166. A pivot connection 168 is provided in the end of rod 170 which is in turn connected to vertical rotatable rod 156. When the motor and gear mechanism 152 rotates the linkage system 154 to the position shown in dotted lines, door 16 is allowed to return to closed position. The door operating lever 158 contacts stud 160 mounted on the top of door 16 to allow opening and closing of the door responsive to operation of the door opening mechanism which is in turn controlled by the defrost control means provided in association with cabinet 10.

An alternate configuration is that operator lever 158 can be bifurcated so that it straddles stud 160 and moves door 16 positively in both the opening and closing direction. Another configuration for the door operating mechanism 150 is that a plurality of solenoids can operate against the doors or portions thereof to open the same or a single solenoid can be arranged to operate a multiple cam rod for opening all doors or only selected doors for a defrost cycle.

Another variation is that the door opening mechanism 150 can be designed to include a motion take-up means of the type described and claimed in U.S. application Ser. No. 145,711 filed May 1, 1980.

Provision of door operating mechanism 150 in association with cabinet 10 enables door 16 to be opened to permit the throughflow of ambient air for defrost purposes. Thus, one of the ambient air ports 50 or 70 can be replaced by providing a door opening mechanism. In the modification shown in FIGS. 4 and 5, the bottom gate 70 has been replaced and cabinet 10 is defrosted by taking in ambient air through top port 52 when gate 50 has been opened as shown in FIG. 5 and then the ambient air moved downwardly in conduit 96 in a reverse direction to that employed in the refrigeration cycle as shown in FIG. 4. The ambient air then contacts the frost and ice accumulated on the refrigeration coils in box 110 and thereafter proceeds upwardly through air grille 94 and out of the bottom portion of gap G created between door 16 and the access opening 48. The defrost air after it has contacted the ice and frost in box 110 has been denoted by the dashed arrows D.

Top ambient air port 152 is directly ducted into conduit 96 by throat member 66 which is discontinuous in the longitudinal direction along the length of cabinet 10 as shown in FIG. 1. The flow of air in the second air conduit 112 is provided in this manner. Due to the operation of the single motor-driven fan assembly 116, ambient air is also drawn into the air conduits 96 and 112 through the top portions of the gap G created between door 16 and access opening 48 as shown by the dashed arrows labeled C; however, the principal flow of ambient air is through top port 52 as described above. The ambient air flow in the second conduit 112 can be restricted by constructing this conduit with a narrower interwall distance than the first conduit 96. A ratio of 1:2 can be used for these distances.

One aspect of the energy efficiency of cabinet 10 is that only a single motor-driven fan assembly 116 is employed for both the refrigeration cycle as shown in FIG. 4 and the defrost cycle as shown in FIG. 5. In the refrigeration cycle of operation, motor-driven fan assembly 116 causes the primary air band A and secondary air band B to flow parallel to the inside surface of door 16 and then into the common inlet chamber 114 prior to entry into the refrigeration coil box 110 and then into conduit 96 for the primary air band and conduit 112 for the secondary air band. These air bands then exit from the conduits at outlet opening 120 for the primary air band and 122 for the secondary band at the top of the cabinet 10 at which position downwardly directed louvers 124 and 126 are provided as in the manner described above. The primary air band A and secondary air band B then flow downwardly as shown by the labeled arrows and into air grille 94 positioned above the common inlet 95. If desired, hot liquid or gas refrigerant lines 172 can be provided as a part of air grille 94 in order to raise the temperatures thereof to prevent condensate and frost formation.

A bottom drain 174 is provided in cabinet 10 as shown in FIGS. 4 and 5 for draining water created by the defrosting of the refrigeration coil box 110 during the defrost cycle as shown in FIG. 5. A front inclined bottom panel 176 is provided for connecting bottom wall 46 with front wall 32. Also a seal 178 is provided for gate 54 in order to better maintain the airtight fit of the gate to port 52.

The embodiment of FIGS. 4–7 additionally avoids any possible problems arising due to the formation of frost and ice near the operating portions of bottom gate 70 described with respect to FIGS. 1–3. These prior art difficulties are minimized according to the present invention by constructing the gates 50 and 70 to open outwardly and by having the opening assemblies outside of the conduits.

Figure 7:
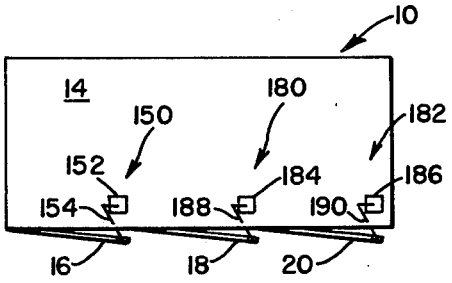
FIG. 7 is a perspective schematic view of a portion of the display cabinet shown in FIG. 1 in which the door opening mechanisms for the three doors are shown.

FIG. 7 shows a top plane view of cabinet 10 when three door opening mechanisms 150, 180 and 182 are provided for doors 16, 18 and 20 respectively. Motor and gear mechanism 184 and 186 and operating linkage system 188 and 190 are provided in the manner described with respect to FIG. 6. All of these door opening mechanisms are only selected ones of these are operated by the defrost control means used in association with cabinet 10.

Figure 8:
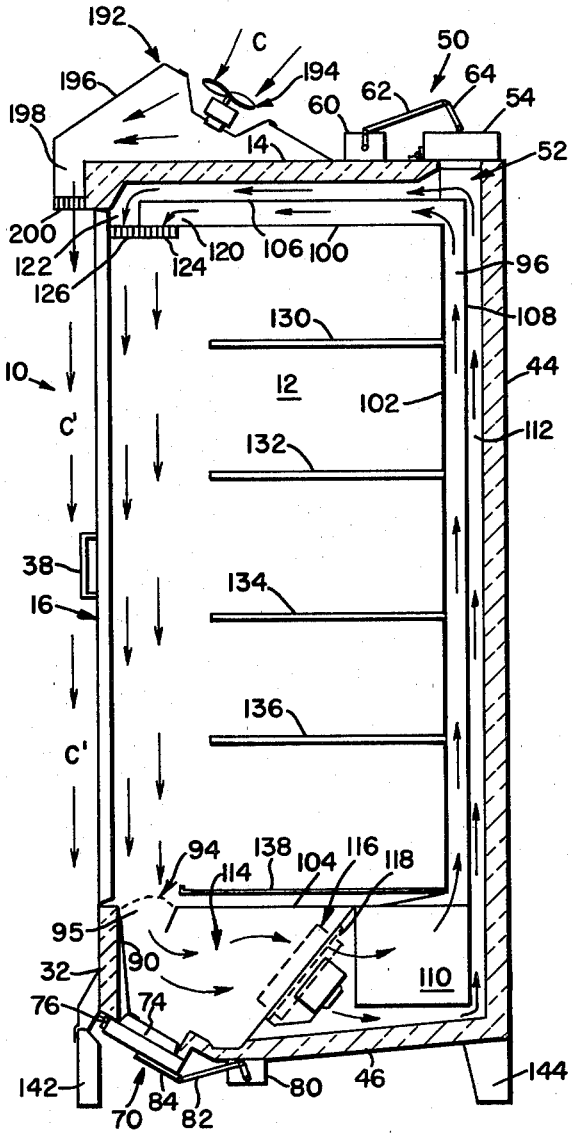
FIG. 8 is a schematic view of another embodiment of the present invention showing an ambient air circulation means arranged at the top portion of the cabinet.
Figure 9:
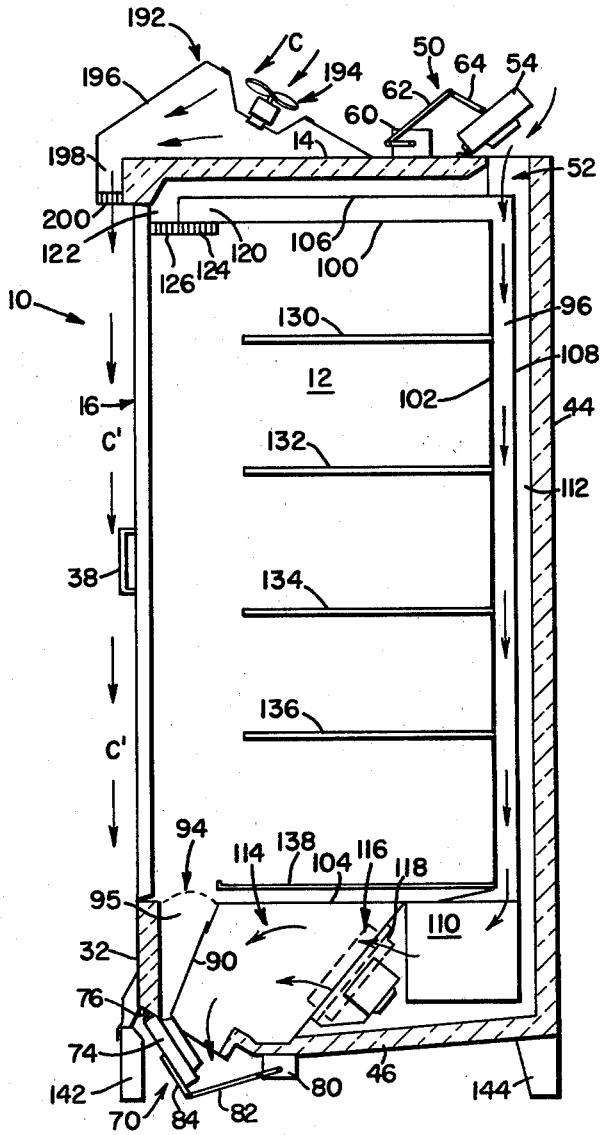

Another embodiment of the present invention is shown in FIGS. 8 and 9 wherein an ambient air flow means 192 is provided at the top of cabinet 10. An ambient air motor-driven fan 194 is mounted in a top fan housing 196 which is supported by top wall 14 and extends over the front edge of top wall 14 to form an ambient air outlet 198 which has downwardly directed louvers 200 positioned therein for directing an ambient air band C′ downwardly across the outer surface of closed barrier door 16. The purpose of this air band is to continuously move ambient air across the heat transfer surface area provided by the outer pane of glass in order to facilitate heat inflow through the glass pane. This additional heat flow raises the temperature of the inner glass pane sufficiently to aid in the preventing of condensate formation on the inner pane. The formation of condensate on the glass pane of a refrigerated glass door covered cabinet produces a fog on the pane which limits customer viewing of the displayed products. Normally, an electrically resistant transparent surface coating is placed on the inner glass pane surface and connected to electrodes which provide electrical current to the coating whereby the entire inner surface of the film is heated to prevent condensate formation. By providing the outer ambient air band C′ the heat transfer through the glass door can be raised so that the electrical current input to the transparent resistant film can be decreased. The decrease in energy for the resistance heating is greater than the energy expended in operating the motor driven fan 194 whereby a net energy savings is obtained.

It has been found more efficient to add heat to the inner glass pane by the flowing ambient air band than by direct input of electrical energy into the transparent electrical resistant coating. This occurs because without a flowing air band, the ambient air contacting the outer surface of the barrier door 16 moves only by convection currents which are not sufficient to prevent the lower of air temperature in the immediate vicinity of the outer door surface.

The remainder of the elements in display cabinet 10 of FIGS. 8 and 9 are identical to the embodiment illustrated in FIGS. 2 and 3 and consequently consistent numerals have been employed.

Ambient air circulation means 192 can be operated only during the refrigeration cycle as shown in FIG. 8 or can be operated also during the defrost cycle of operation as shown in FIG. 9 in order to maintain the inner surface of the barrier door at a slightly elevated temperature so that fogging is less likely to occur when the refrigeration cycle is again established following defrost of the refrigeration coil box 110.

Also, if desired, the ambient air circulation means 192 can be installed on the embodiment of cabinet 10 illustrated in FIGS. 4–10 and in this case the operation of the ambient air circulation means during a defrost cycle provides the additional advantage that ambient air is then forced into the cabinet through the gap G at the top of the door which then creates additional ambient air flow in the top portions of the air conduits. This effect is particularly pronounced in respect to the first air conduit 96 of FIG. 5. The ambient air band also decreases turbulent air contact when the barrier doors are opened.

In summary, a refrigerated display cabinet is provided in which a plurality of circulated air bands are established in a refrigeration cycle within the cabinet about the display space in order to decrease the direct contact of the refrigerated air band with the outer surfaces of the cabinet. Air defrost means are provided by at least two aperture openings in the cabinet which are covered during the refrigeration cycle of operation. Three different covering means are provided for three different apertures. One of thses apertures can be the access opening which is covered by the barrier door. Additionally, ambient air ports can be provided directly into the air conduits and covered by openable gates. The inclusion of the secondary air band in the refrigeration cycle of operation in a display cabinet according to the present invention increases the interior surface temperature about 10° F. to 15° F. over that temperature which would be present without the secondary air band. This secondary air band also protects the refrigerated primary air band from direct contact with ambient air upon opening of the barrier doors to add or remove products from the display case.

An additional operating variation is that the volume of air moved through the motor-driven fan assembly can be varied during the defrost cycle with respect to the air flow during the refrigeration cycle. This air volume can be either higher or lower than during refrigeration or it can be equal to the air flow during a refrigeration cycle. The termination of the defrost operation is normally set so that when the coldest spot of the coil reaches a predetermined value of, for example, 50° F., the defrost cycle will terminate. This can be provided by a temperature sensor known as a KLIXON which can be positioned in the refrigeration coil box 110.

The operating controls hierarchy to operate display cabinet 10 in both the refrigeration and defrost cycles can be arranged in a similar fashion to the above-referred to related applications in which controlled hierarchies are described.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In a display cabinet having refrigeration means and a display space therein, aperture means in at least one wall of said cabinet for communicating ambient outside air with the air in said cabinet, said aperture means including an access opening for permitting products to be moved into and out of said display space, covering means for said aperture means including at least one barrier door for substantially covering said access opening; said aperture means including at least one additional opening and said covering means having at least one gate for covering said additional opening; the improvement comprising:

air circulation means for providing selective circulation of a plurality of air bands in a path within said cabinet about said display space to maintain air flow curtains inside of said cabinet adjacent to said barrier door, at least one of said air bands cooled by contact with said refrigeration means; and said cabinet including conduit means enabling said air bands to flow in contact with one another over a part of the circulation path in addition to the length of said air flow curtains.

2. The improvement according to claim 1, wherein said air circulation means comprises a series of motor-driven fans positioned longitudinally within said cabinet and wherein each of said fans circulate said plurality of air bands.

3. The improvement according to claim 1, wherein a primary air band is circulated about said display space in contact with said refrigeration means, and wherein a secondary air band is circulated about said primary air band within said display cabinet and is maintained at a temperature of from 10° F. to 15° F. above the temperature of said primary air band.

4. The improvement according to claim 3, wherein a first air conduit is arranged inside of said cabinet about said display space to contain said primary air band during a portion of its flow within said cabinet, and wherein a second air conduit is arranged inside of said cabinet about said first air conduit to contain said secondary air band during a portion of its flow within said cabinet.

5. The improvement according to claim 1, wherein said aperture means comprises at least two additional openings and wherein said covering means includes gates for covering said openings, one of said additional openings located at the top portion of said cabinet and one of said additional openings located at the bottom portion of said cabinet and said openings arranged to enable the through-flow of ambient air during a defrost cycle in the circulation path in which the air band cooled by said refrigeration means flows during the refrigeration cycle.

6. The improvement according to claim 5, wherein said air circulation means reverses the flow of direction of said plurality of air bands during the defrost cycle of operation and enables through-flow of ambient air to contact and defrost said refrigeration means.

7. The improvement according to claim 5, wherein said air circulation means reverse the flow direction of said plurality of air bands during the defrost cycle of operation and enables the flow of ambient air into the top-most opening and out of the bottom-most opening.

8. The improvement according to claims 5, 6 or 7 wherein at least one of said gates has affixed thereto a diverter vane means for directing the flow of ambient air through a portion of said cabinet during a defrost cycle of operation.

9. The improvement according to claim 5, wherein opening means are provided for operating said gates to enable through-flow of ambient air during a defrost cycle of operation.

10. The improvement according to claim 9, wherein an air defrost means is provided for controlling said opening means.

11. The improvement according to claim 1, wherein door opening means are provided for creating a gap between said barrier door and said access opening during a defrost cycle of operation to permit the through-flow of ambient air within said cabinet.

12. The improvement according to claim 11, wherein an air defrost means is provided for controlling said door opening means.

13. The improvement according to claim 11, wherein said door opening means includes motion take-up means to permit said barrier door to be closed by an outside force and to reopen when the force is removed.

14. The improvement according to claims 9 or 11, wherein said opening means comprise motor driven mechanical linkages.

15. The improvment according to claims 9 or 11, wherein said opening means comprise electrical solenoids.

16. The improvement according to claims 1, 5 or 11, wherein an ambient air circulating means is provided for establishing an ambient air band flow across at least a portion of the outer surface of said barrier door during at least the refrigeration cycle of operation.

17. A display cabinet having refrigeration means and a display space therein, and having aperture means in at least one wall of said cabinet for communicating ambient outside air with the air in said cabinet, and including cover means for said aperture means; comprising:

an access opening for permitting products to be moved into and out of said display space and at least one additional opening, and said cover means including at least one barrier door for blocking said access opening and a gate for controlling ambient air entry into said additional opening, air circulation means for providing selective circulation of a plurality of air bands in a path within said cabinet about said display space to maintain air flow curtains inside of said cabinet adjacent to said barrier door, at least one of said air bands cooled by contact with said refrigeration means and the other of said air bands flowing in contact with a substantial portion of the inner surface of said barrier door during a refrigeration cycle, and said cabinet including conduit means enabling said air bands to flow in contact with one another over a path of the circulation path in addition to the length of said air flow curtains.

18. The improvement according to claim 17, wherein said air circulation means comprises a series of motor driven fans positioned longitudinally within said cabinet and wherein each of said fans circulates said plurality of air bands.

19. The improvement according to claim 17, wherein a primary air band is circulated about said display space in contact with said refrigeration means, and wherein a secondary air band is circulated about said primary air band within said display cabinet and is maintained at a temperature of from 10° F. to 15° F. above the temperature of said primary air band.

20. The improvement according to claim 19, wherein a first air conduit is arranged inside of said cabinet about said display space to contain said primary air band during a portion of its flow within said cabinet, and wherein a second air conduit is arranged inside of said cabinet about said first air conduit to contain said secondary air band during a portion of its flow within said cabinet.

21. The improvement according to claim 17, wherein said aperture means comprises two additional openings and wherein said covering means include gates for blocking said openings, one of said additional openings located at the top portion of said cabinet and one of said additional openings located at the bottom portion of said cabinet and said openings arranged to enable the through-flow of ambient air during a defrost cycle in the circulation path of the air band cooled by said refrigeration means during the refrigeration cycle.

22. The improvement according to claim 17, wherein said air circulation means reverses the flow direction of said plurality of air bands during the defrost cycle of operation and enables through-flow of ambient air to contact and defrost said refrigeration means.

23. The improvement according to claim 21, wherein said air circulation means reverses the flow direction of said plurality of air bands during the defrost cycle of operation and enables the flow of ambient air into the top-most opening and out of the bottom-most opening.

24. The improvement according to claim 21, wherein opening means are provided for operating said gates to enable through-flow of ambient air during a defrost cycle of operation.

25. The improvement according to claims 21 or 24 wherein at least one of said gates has affixed thereto a diverter vane means for directing the flow of ambient air through a portion of said cabinet during a defrost cycle of operation.

26. The improvement according to claim 24, wherein an air defrost means is provided for controlling said opening means.

27. The improvement according to claim 17, wherein door opening means are provided for creating a gap between said barrier door and said access opening during a defrost cycle of operation to permit the through-flow of ambient air.

28. The improvement according to claim 27, wherein said door opening means is controlled by an air defrost means.

29. The improvement according to claim 27, wherein said door opening means includes a motion take-up means to permit said barrier door to be closed by an outside force and to reopen when the force is removed.

30. The improvement according to claims 24 or 27, wherein said opening means includes motor driven mechanical linkages.

31. The improvement according to claims 24 or 27 wherein said opening means includes electrical solenoid means.

32. The improvement according to claims 17, 21, 27 wherein an ambient air circulating means is provided for establishing an ambient air band flow across at least a portion of the outer surface of said barrier door during the refrigeration cycle of operation.

33. The improvement according to claims 9 or 24, wherein said gate opening means are positioned on an outside surface of said display cabinet.

34. A method of operating a refrigerated display cabinet having a display space therein, aperture means in at least one wall of the cabinet for communicating ambient outside air with the air in the cabinet, the aperture means including an access opening for permitting products to be moved into and out of the display space, covering means for the aperture means including at least one barrier door for substantially covering the access opening, the aperture means including at least one additional opening and the covering means having at least one gate for covering the additional opening, air circulation means for providing selective circulation of a plurality of air bands in paths within the cabinet about the display space to maintain an air flow curtain inside of the cabinet adjacent to the barrier door, at least one of the air bands cooled by contact with the refrigeration means, and the cabinet including conduit means enabling the air bands to flow in contact with one another over a part of the circulation path in addition to the length of the air flow curtains; the method comprising the steps of:

selectively operating the display cabinet in a refrigeration cycle of operation and in a defrost cycle of operation; during a refrigeration cycle, circulating the air bands through the conduit means so that the air bands maintain air flow curtains inside of the cabinet adjacent to the barrier door, and propelling at least one of the air bands through the refrigeration means; during a defrost cycle of operation, terminating operation of the refrigeration means, opening the cover means for the aperture means and reversing the direction of the air circulation means, causing ambient air to be drawn into the display cabinet and to flow through the conduit means and into contact with the refrigeration means to defrost the same, and causing the defrost ambient air to be ejected from the cabinet through the aperture means.

35. A method according to claim 34 wherein the aperture means comprises at least two additional openings and wherein the covering means include gates for covering the openings, one of the additional openings located at the top portion of the cabinet and one of the additional openings located at the bottom portion of the cabinet; including the additional step during a defrost cycle of opening the gates covering the additional openings and causing ambient air to move through the additional openings and through the conduit means and into contact with the refrigeration means to defrost the same.

36. A method according to claim 34, wherein the barrier door and the covering means for the additional opening permit entry of ambient air during the defrost cycle of operation in order to contact and defrost the refrigeration means.

* * * * *